US009635742B2

(12) United States Patent
Sun et al.

(10) Patent No.: US 9,635,742 B2
(45) Date of Patent: Apr. 25, 2017

(54) LED LIGHTING DEVICE AND SYSTEM CONTAINING ANTENNA, AND RELATED CONFIGURING METHOD

(71) Applicant: SENGLED OPTOELECTRONICS CO., LTD., Tongxiang (CN)

(72) Inventors: Chaoqun Sun, Tongxiang (CN); Jinxiang Shen, Tongxiang (CN); Xiaofei Chen, Tongxiang (CN)

(73) Assignee: SENGLED OPTOELECTRONICS CO., LTD., Tongxiang (CN)

( * ) Notice: Subject to any disclaimer, the term of this patent is extended or adjusted under 35 U.S.C. 154(b) by 0 days.

(21) Appl. No.: 15/022,590

(22) PCT Filed: Mar. 9, 2015

(86) PCT No.: PCT/CN2015/073870
§ 371 (c)(1),
(2) Date: Mar. 17, 2016

(87) PCT Pub. No.: WO2015/149605
PCT Pub. Date: Oct. 8, 2015

(65) Prior Publication Data

US 2016/0227636 A1 Aug. 4, 2016

(30) Foreign Application Priority Data

Apr. 3, 2014 (CN) ..... 2014 1 0133329

(51) Int. Cl.
*F21V 29/00* (2015.01)
*H05B 37/02* (2006.01)
(Continued)

(52) U.S. Cl.
CPC ..... *H05B 37/0272* (2013.01); *F21K 9/23* (2016.08); *F21V 17/06* (2013.01); *F21V 19/003* (2013.01);
(Continued)

(58) Field of Classification Search
None
See application file for complete search history.

(56) References Cited

U.S. PATENT DOCUMENTS

2012/0274208 A1* 11/2012 Chen ..... H01Q 1/38 315/34
2012/0293652 A1* 11/2012 Farmer ..... F21V 29/20 348/143
(Continued)

FOREIGN PATENT DOCUMENTS

CN 202075798 U 12/2011
CN 102425734 A 4/2012
(Continued)

OTHER PUBLICATIONS

The World Intellectual Property Organization (WIPO) International Search Report for PCT/CN2015/073870 May 29, 2015.

*Primary Examiner* — Dedei K Hammond
(74) *Attorney, Agent, or Firm* — Anova Law Group, PLLC

(57) ABSTRACT

Antenna-containing LED lighting devices, systems and configuring methods are provided. An exemplary LED lighting device includes an LED light source component unit and an LED driving circuit and power supply unit configured to drive the LED light source component unit and to power the LED lighting device. The LED lighting device further includes a heat sink, an RF antenna, and an RF circuit. The RF antenna is configured to have an antenna top plane containing a highest point of the RF antenna coplanar with or lower than a heat sink top plane containing a highest point of the heat sink. The RF antenna is configured without affecting a light-emitting path from the LED light source component unit.

15 Claims, 6 Drawing Sheets

(51) Int. Cl.

| | |
|---|---|
| ***F21V 23/04*** | (2006.01) |
| ***F21K 9/23*** | (2016.01) |
| ***F21V 29/74*** | (2015.01) |
| ***F21V 17/06*** | (2006.01) |
| ***F21V 19/00*** | (2006.01) |
| ***H01Q 1/22*** | (2006.01) |
| ***H05B 33/08*** | (2006.01) |
| *F21Y 101/02* | (2006.01) |
| *F21Y 115/10* | (2016.01) |

(52) U.S. Cl.
CPC ..... *F21V 23/045* (2013.01); *F21V 29/74* (2015.01); *H01Q 1/22* (2013.01); *H05B 33/0842* (2013.01); *F21Y 2101/02* (2013.01); *F21Y 2115/10* (2016.08)

(56) References Cited

U.S. PATENT DOCUMENTS

2013/0136454 A1* 5/2013 Yu ..... H05B 33/0803
398/106
2013/0285544 A1* 10/2013 Molezion ..... H01Q 1/007
315/34

FOREIGN PATENT DOCUMENTS

CN 103636293 A 3/2014
CN 103912810 A 7/2014
CN 203810121 U 9/2014

* cited by examiner

LED LIGHTING DEVICE AND SYSTEM CONTAINING ANTENNA, AND RELATED CONFIGURING METHOD

CROSS-REFERENCES TO RELATED APPLICATIONS

This application is a national stage application under 35 USC §371(c) of PCT Application No. PCT/CN2015/073870, entitled "LED LIGHTING DEVICE AND SYSTEM CONTAINING ANTENNA, AND RELATED CONFIGURING METHOD," filed on Mar. 9, 2015, which claims the priority of Chinese Patent Application No. 201410133329.5, filed on Apr. 3, 2014, the entire disclosure and contents of the above applications are hereby incorporated by reference herein.

FIELD OF THE DISCLOSURE

The present disclosure relates to the field of light emitting diode (LED) technologies and, more particularly, relates to an LED lighting system and antenna arrangement and related method of the LED lighting system.

BACKGROUND

Wireless technology has been applied to various electronic products and has freed people from cumbersome cablings and assemblies. Products with wireless technologies are now commonly used. LED devices have also been widely used in various areas for public or office indoor lighting. LED lighting may provide advantages including energy conservation, environmental protection, controllable lighting, solid-state lighting, and long operational lifetime. Smart control and multimedia functions may be integrated with the LED lighting due to its unique methods for power supply and control.

Smart LED lighting devices may be wirelessly controlled using antennas. Depending on specific designs, the antennas may directly affect the quality and stability of RF signals. RF antennas that are currently used in LED lighting devices may include printed circuit board (PCB) antennas, onboard ceramic antennas, metal film antennas, flexible printed circuit board (FPC) antennas, and laser direct structuring (LDS) antennas. When used in an LED lighting device, these antennas may be constrained by the outer shape and dimensions of the LED lighting device and may not have desired performances.

The disclosed devices, systems, and methods are directed to solve one or more problems set forth above and other problems.

BRIEF SUMMARY OF THE DISCLOSURE

One aspect of the present disclosure provides an LED lighting device. The LED lighting device includes an LED light source component unit, an LED driving circuit and power supply unit, configured to drive the LED light source component unit and to power the LED lighting device, a heat sink, an RF antenna, and an RF circuit. The RF antenna is configured to have an antenna top plane containing a highest point of the RF antenna coplanar with or lower than a heat sink top plane containing a highest point of the heat sink. The RF antenna is configured without affecting a light-emitting path from the LED light source component unit.

The LED light source component unit includes an LED board and at least one LED light source configured on the LED board.

Optionally, the RF antenna has an annular shape with a central aperture to allow light beam emitted from the LED light source component unit to pass through the central aperture without affecting the light-emitting path from the LED light source component unit.

The heat sink includes a heat sink body, a plurality of heat sink fins longitudinally configured and distributed on an upper portion along an outer periphery of the heat sink body, and a cooling case housing the plurality of heat sink fins. The LED board is fixed on a top surface of the heat sink body. The RF antenna is socket-configured on an outer periphery of the LED board. An upper portion of the cooling case is higher than a top surface of each of the plurality of heat sink fins and the RF antenna.

The RF antenna is a printed circuit board (PCB) antenna or an onboard ceramic antenna, and has an annular shape. The cooling case has a circular cross-section. The LED board has a circular shape. An outer periphery of the RF antenna and an inner sidewall of the cooling case are separated by a gap. The RF antenna and the cooling case are connected by snap connectors.

Optionally, the RF antenna is a metal film antenna. The LED light source component unit further includes a lens mounted on the LED board, and the lens is transparent to visible light and covers the LED light source. The RF antenna is configured around a lower periphery of the lens.

The heat sink includes a heat sink body, a plurality of heat sink fins longitudinally configured and distributed on an upper portion along an outer periphery of the heat sink body, and a cooling case housing the plurality of heat sink fins. The LED board is fixed on a top surface of the heat sink body. An upper portion of the cooling case is higher than a top surface of the RF antenna.

Optionally, the RF antenna is a flexible printed circuit board (FPC) antenna or a laser direct structuring (LDS) antenna. The LED light source component unit further includes a reflecting shade mounted on the LED board. The RF antenna is mounted on the reflecting shade. The heat sink includes a heat sink body, a plurality of heat sink fins longitudinally configured and distributed on an upper portion along an outer periphery of the heat sink body, and a cooling case housing the plurality of heat sink fins. The LED board is fixed on a top surface of the heat sink body. Upper portions of both the plurality of heat sink fins and the cooling case are higher than the LED board to form a cavity over the LED board. The reflecting shade is configured in the cavity.

Optionally, the RF antenna is an inverted F antenna (IFA), a planar inverted F antenna (PIFA), a Monopole antenna, or a loop antenna. The LED lighting device further includes a shell as a part of the heat sink.

Various embodiments also include an LED lighting system including the disclosed LED lighting devices and a terminal configured to wirelessly control and communicate with the LED lighting device.

Another aspect of the present disclosure provides a method for configuring an RF antenna in an LED lighting device having a heat sink. The RF antenna is configured to have an antenna top plane containing a highest point of the RF antenna coplanar with or lower than a heat sink top plane containing a highest point of the heat sink. A light-emitting path from the LED lighting device is not affected by the configured RF antenna.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Figure 1:
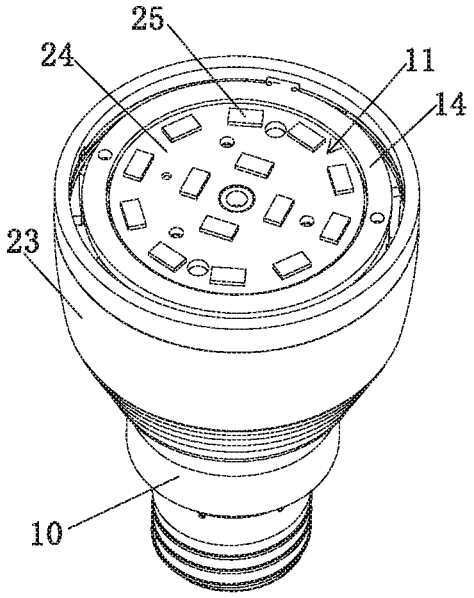
FIG. 1 is a three-dimensional illustration of an exemplary LED lighting device consistent with various disclosed embodiments.
Figure 2:
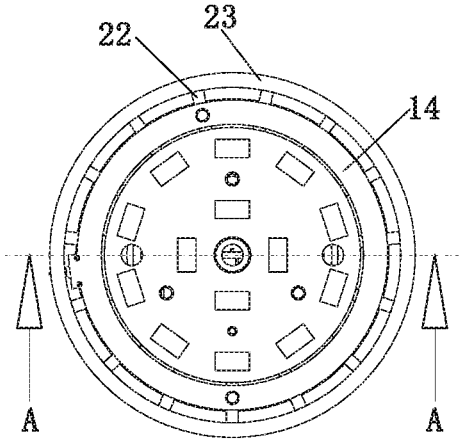
FIG. 2 is a top view of the exemplary LED lighting device of FIG. 1 consistent with various disclosed embodiments.
Figure 3:
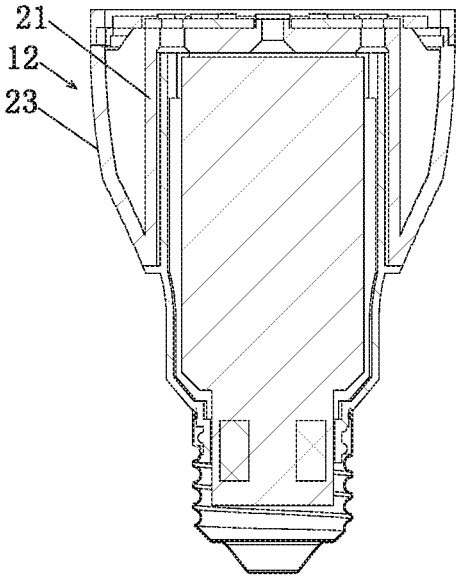
FIG. 3 is a cross-section illustration along A-A direction of FIG. 2 consistent with various disclosed embodiments.
Figure 4:
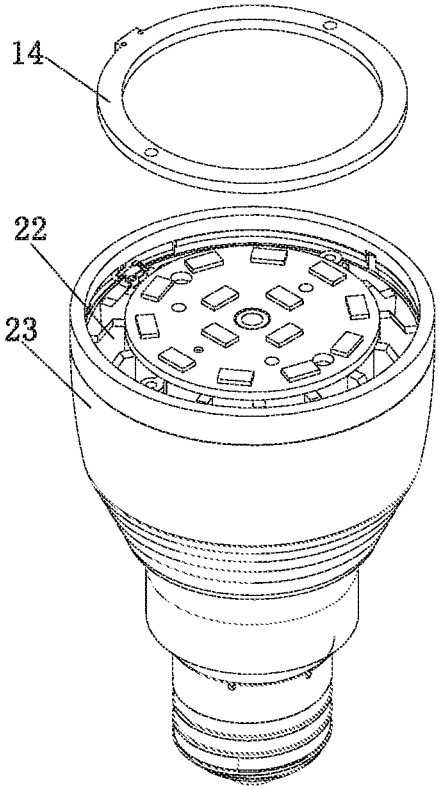
FIG. 4 is a splitting illustration of an exemplary RF antenna in the exemplary LED lighting device of FIG. 1 consistent with various disclosed embodiments.
Figure 5:
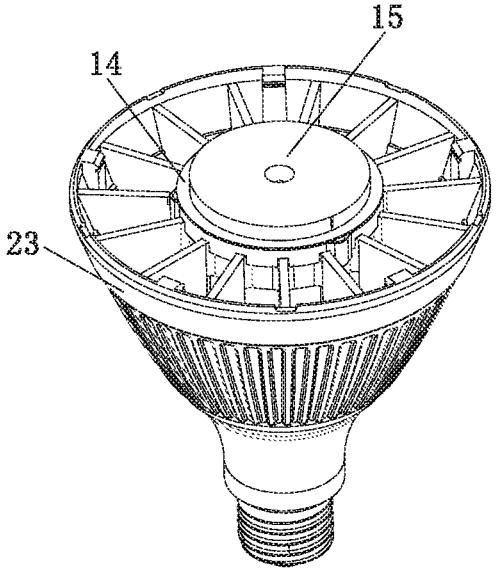
FIG. 5 is a three-dimensional illustration of another exemplary LED lighting device consistent with various disclosed embodiments.
Figure 6:
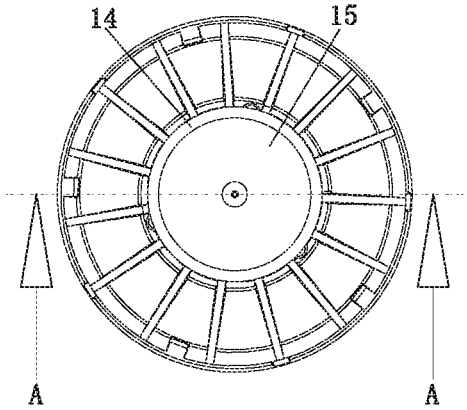
FIG. 6 is a top view of the exemplary LED lighting device of FIG. 5 consistent with various disclosed embodiments.
Figure 7:
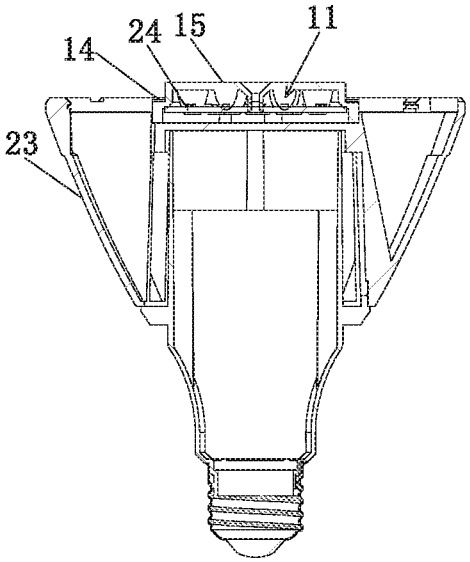
FIG. 7 is a cross-section illustration along A-A direction of FIG. 6 consistent with various disclosed embodiments.
Figure 8:
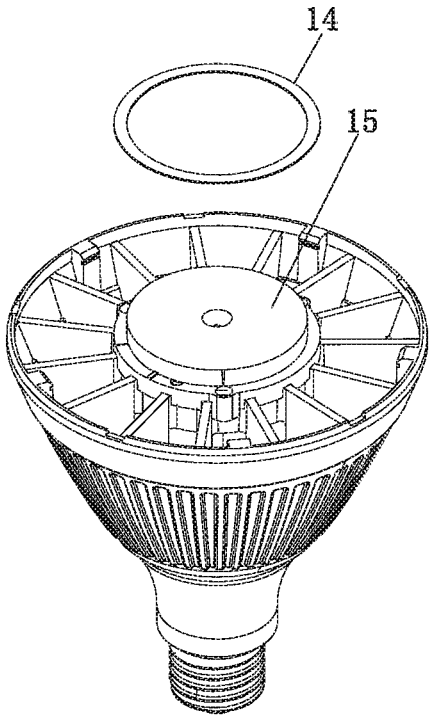
FIG. 8 is a splitting illustration of an exemplary RF antenna in the exemplary LED lighting device of FIG. 5 consistent with various disclosed embodiments.

Reference will now be made in detail to exemplary embodiments of the invention, which are illustrated in the accompanying drawings. Hereinafter, embodiments consistent with the disclosure will be described with reference to drawings. Wherever possible, the same reference numbers will be used throughout the drawings to refer to the same or like parts. It is apparent that the described embodiments are some but not all of the embodiments of the present invention. Based on the disclosed embodiment, persons of ordinary skill in the art may derive other embodiments consistent with the present disclosure, all of which are within the scope of the present invention.

Antenna-containing LED lighting devices, systems and configuring methods are provided. An exemplary LED lighting device includes an LED light source component unit and an LED driving circuit and power supply unit configured to drive the LED light source component unit and to power the LED lighting device. The LED lighting device further includes a heat sink, an RF antenna, and an RF circuit. The RF antenna is configured to have an antenna top plane (e.g., a substantially horizontal plane) containing a highest point of the RF antenna coplanar with or lower than a heat sink top plane (e.g., a substantially horizontal plane) containing a highest point of the heat sink. The RF antenna is configured without affecting a light-emitting path from the LED light source component unit.

The disclosed antenna-containing LED lighting devices, systems, and configuring methods may thus have desired RF properties for wireless communication and wireless control. Compared with existing technologies, the disclosed RF antenna is configured to have the antenna top plane containing the highest point of the RF antenna coplanar with or lower than the heat sink top plane containing the highest point of the heat sink. Therefore, the quality and stability of the RF signals are improved without affecting the light-emitting path of the LED lighting device.

FIGS. 1-4 illustrate an exemplary LED lighting device consistent with various disclosed embodiments of present disclosure. As shown in FIGS. 1-4, the LED lighting device may include an LED driving circuit and power supply unit 10, an LED light source component unit 11, a heat sink 12, an RF circuit (not shown), and an RF antenna 14.

The LED driving circuit and power supply unit 10 can drive the LED light source component unit 11, and provide power to the entire LED lighting device 1. The RF circuit can be configured in the LED lighting device 1 and can be electrically connected to the RF antenna 14. The RF antenna 14 can be configured to transmit and receive RF signals. The LED light source component unit 11 may include a circular LED board 24, which may be configured with at least one LED light source 25.

The RF antenna 14 shown in FIGS. 1-4 may be a PCB antenna made of PCB materials having various different dielectric constants, or an onboard ceramic antenna made of ceramic materials having various different dielectric constants, or any other suitable antennas.

The heat sink 12 may include a heat sink body 21 and a plurality of heat sink fins 22 longitudinally configured and distributed on an upper portion along the outer periphery of the heat sink body 21. The heat sink fins 22 may be housed by a cooling case 23. The LED board 24 may be fixed on a top surface of the heat sink body 21.

The RF antenna 14 may have an annular shape with a central aperture to allow light beam emitted from the LED light source component unit 11 to pass through the central aperture of the RF antenna 14 without affecting the light-emitting path from the LED light source component unit 11.

The inner diameter of the RF antenna 14 may equal to the outer diameter of the LED board 24. The RF antenna 14 may be socket-configured along the outer periphery of the LED board 24. The upper portion of the cooling case 23 may be higher than the top surfaces of the heat sink fins 22 and the RF antenna 14. The outer periphery of the RF antenna 14 and the inner sidewall of the cooling case 23 may be separated by a gap. The RF antenna 14 and the cooling case 23 may be connected with snap connectors.

FIGS. 5-8 illustrate another exemplary LED lighting device consistent with various disclosed embodiments. Compared with the exemplary LED lighting device in FIGS. 1-4, the RF antenna 14 shown in FIGS. 5-8 may be a metal film antenna made of unique metal materials capable of improving the dielectric constant. The LED light source component unit 11 may further include a lens 15 fixed on the circular LED board 24. The lens 15 may be transparent to visible light and may cover the LED light source. The RF antenna 14 may be an annular metal film antenna mounted around the outer periphery of the lower portion of the lens 15, such that the configured RF antenna 14 does not affect light-emitting path from the light source component unit 11. The antenna top plane containing the highest point of the RF antenna 14 is lower than a plane (e.g., a horizontal plane) containing the highest point of the cooling case 23.

Figure 9:
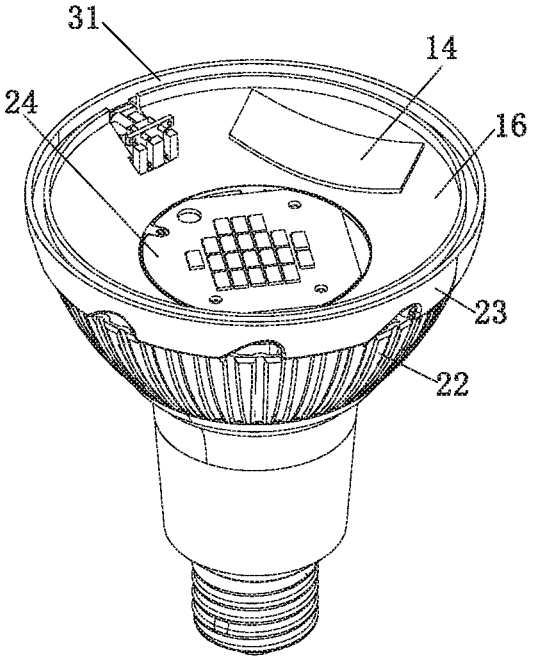
FIG. 9 is a three-dimensional illustration of an exemplary LED lighting device consistent with various disclosed embodiments.
Figure 10:
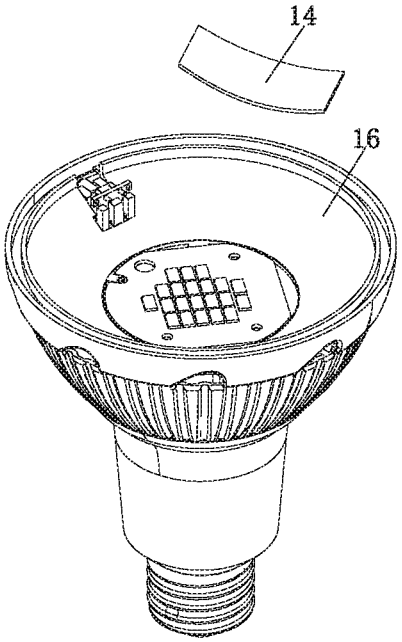
FIG. 10 is a splitting illustration of an exemplary RF antenna in the exemplary LED lighting device of FIG. 9 consistent with various disclosed embodiments.
Figure 11:
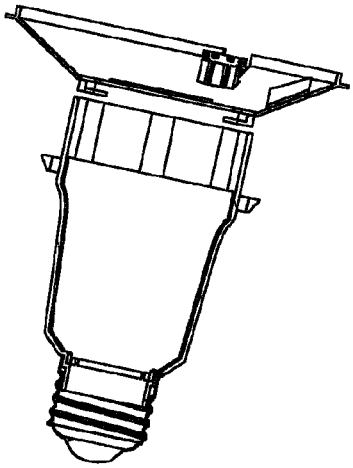
FIG. 11 is another three-dimensional illustration of the exemplary LED lighting device of FIG. 9 consistent with various disclosed embodiments.

FIGS. 9-11 illustrate another exemplary LED lighting device consistent with various disclosed embodiments. Compared with the exemplary LED lighting device in FIGS. 1-4, the RF antenna 14 shown in FIGS. 9-11 may be a FPC antenna made of flexible materials with various different dielectric constants, or an LDS antenna made by laser direct structuring technology. The LED light source component unit 11 may further include a reflecting shade (or cover) 16 fixed on the LED board. The upper portion of each of the cooling case 23 and the heat sink fins 22 may be higher than a top surface of the LED board 24. A cavity 31 can be defined by the upper portion of the heat sink fins 22, the upper portion of the cooling sink 23, and the LED board 24 as shown in FIG. 9. The reflecting shade 16 may be located in the cavity 31. The RF antenna 14 may be mounted on the reflecting shade 16 without affecting the light-emitting path from the LED light source component unit 11. The antenna top plane containing a highest point of the RF antenna 14 may be coplanar with or lower than a heat sink top plane containing a highest point of the heat sink.

As such, the disclosed RF antenna 14 (e.g., shown in FIGS. 1-11) can be configured such that an antenna top plane that contains the highest point of the RF antenna 14 is lower than a heat-sink top plane that contains the highest point of the heat sink 12, without affecting a light-emitting path from the LED light source component unit 11. In other embodiments, the antenna top plane of the RF antenna 14 can be configured in parallel with the heat-sink top plane of the heat sink 12. For example, the antenna top plane of the RF antenna 14 can be configured coplanar (in a same plane) with the heat-sink top plane of the heat sink 12.

For illustration purposes, the present disclosure is primarily described with respect to an exemplary LED lighting device configured or placed in a position to emit light upwardly.

In some embodiments, the disclosed LED lighting device may further include a shell. The shell may be a part of the heat sink 12.

Figure 12:
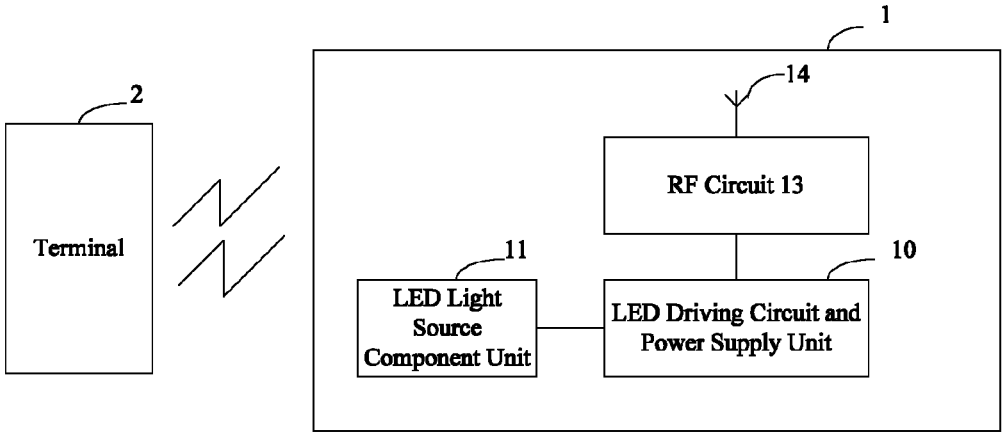
FIG. 12 is a block diagram illustrating an exemplary LED lighting system consistent with various disclosed embodiments.

FIG. 12 shows an exemplary LED lighting system consistent with various disclosed embodiments of the present disclosure. The LED lighting system may include the LED lighting device 1 configured with the RF antenna 14 and a terminal 2. Terminal 2 is configured to provide wireless control and communication with the LED lighting device 1 through the RF antenna 14.

The embodiments disclosed herein are exemplary only. Other applications, advantages, alternations, modifications, or equivalents to the disclosed embodiments are obvious to those skilled in the art and are intended to be encompassed within the scope of the present disclosure.

INDUSTRIAL APPLICABILITY AND ADVANTAGEOUS EFFECTS

Without limiting the scope of any claim and/or the specification, examples of industrial applicability and certain advantageous effects of the disclosed embodiments are listed for illustrative purposes. Various alternations, modifications, or equivalents to the technical solutions of the disclosed embodiments can be obvious to those skilled in the art and can be included in this disclosure.

Antenna-containing LED lighting devices, systems and configuring methods are provided. An exemplary LED lighting device includes an LED light source component unit and an LED driving circuit and power supply unit configured to drive the LED light source component unit and to power the LED lighting device. The LED lighting device further includes a heat sink, an RF antenna, and an RF circuit. The RF antenna is configured to have an antenna top plane containing a highest point of the RF antenna coplanar with or lower than a heat sink top plane containing a highest point of the heat sink.

The RF antenna is configured without affecting a light-emitting path from the LED light source component unit. In embodiments consistent with the present disclosure, the RF antenna may be configured into various shapes so that the antenna would conform to shape of the LED lighting device without obstructing the lighting path of the device.

The disclosed antenna-containing LED lighting devices, systems and configuring methods may thus have desired RF properties for wireless communication and wireless control. Compared with existing technologies, the disclosed RF antenna is configured to have the antenna top plane containing the highest point of the RF antenna coplanar with or lower than the heat sink top plane containing the highest point of the heat sink. Therefore, the quality and stability of the RF signals are improved without affecting the light-emitting path of the LED lighting device.

REFERENCE SIGN LIST

LED lighting device 1
LED driving circuit and power supply unit 10
LED light source component unit 11
Heat sink 12
RF Circuit 13
RF antenna 14
Lens 15
Reflecting shade 16
Heat sink body 21
Heat sink fins 22
Cooling case 23
LED board 24
LED light source 25
Cavity 31
Terminal 2

What is claimed is:

1. An LED lighting device, comprising:

an LED light source component unit; an LED driving circuit and power supply unit, configured to drive the LED light source component unit and to power the LED lighting device; a heat sink; an RF antenna; and an RF circuit, wherein:

the RF antenna is a flexible printed circuit board (FPC) antenna or a laser direct structuring (LDS) antenna and is configured to have an antenna top plane containing a highest point of the RF antenna coplanar with or lower than a heat sink top plane containing a highest point of the heat sink, the RF antenna is configured without affecting a light-emitting path of the LED light source component unit, and the LED light source component unit including an LED board and at least one LED light source configured on the LED board and a reflecting shade mounted on the LED board, the RF antenna being mounted on the reflecting shade.

2. The LED lighting device according to claim 1, wherein the RF antenna has an annular shape with a central aperture to allow light beam emitted from the LED light source component unit to pass through the central aperture without affecting the light-emitting path of the LED light source component unit.

3. The LED lighting device according to claim 2, wherein:

the heat sink includes a heat sink body, a plurality of heat sink fins longitudinally configured and distributed on an upper portion along an outer periphery of the heat sink body, and a cooling case housing the plurality of heat sink fins, the LED board is fixed on a top surface of the heat sink body, the RF antenna is socket-configured on an outer periphery of the LED board, and an upper portion of the cooling case is higher than a top surface of each of the plurality of heat sink fins and the RF antenna.

4. The LED lighting device according to claim 3, wherein:

the RF antenna is a printed circuit board (PCB) antenna or an onboard ceramic antenna, and has an annular shape;

the cooling case has a circular cross-section;

the LED board has a circular shape;

an outer periphery of the RF antenna and an inner sidewall of the cooling case are separated by a gap; and the RF antenna and the cooling case are connected by snap connectors.

5. The LED lighting device according to claim 1, wherein:

the RF antenna is a metal film antenna, the LED light source component unit further includes a lens mounted on the LED board, and the lens is transparent to visible light and covers the LED light source, and the RF antenna is configured around a lower periphery of the lens.

6. The LED lighting device according to claim 5, wherein:

the heat sink includes a heat sink body, a plurality of heat sink fins longitudinally configured and distributed on an upper portion along an outer periphery of the heat sink body, and a cooling case housing the plurality of heat sink fins, the LED board is fixed on a top surface of the heat sink body, and an upper portion of the cooling case is higher than a top surface of the RF antenna.

7. The LED lighting device according to claim 1, wherein:

the heat sink includes a heat sink body, a plurality of heat sink fins longitudinally configured and distributed on an upper portion along an outer periphery of the heat sink body, and a cooling case housing the plurality of heat sink fins, the LED board is fixed on a top surface of the heat sink body, upper portions of both the plurality of heat sink fins and the cooling case are higher than the LED board to form a cavity over the LED board, and the reflecting shade is configured in the cavity.

8. The LED lighting device according to claim 1, wherein the RF antenna is an inverted F antenna (IF A), a planar inverted F antenna (PIF A), a Monopole antenna, or a loop antenna.

9. The LED lighting device according to claim 1, wherein the LED lighting device further includes a shell as a part of the heat sink.

10. An LED lighting system, comprising of the LED lighting device in claim 1, and a terminal configured to wirelessly control and communicate with the LED lighting device.

11. A method for configuring an RF antenna in an LED lighting device having a heat sink, comprising:

configuring the RF antenna to have an antenna top plane containing a highest point of the RF antenna coplanar with or lower than a heat sink top plane containing a highest point of the heat sink, wherein a light-emitting path of the LED lighting device is not affected by the configured RF antenna; and mounting the RF antenna on the reflecting shade, wherein the RF antenna is a flexible printed circuit board (FPC) antenna or a laser direct structuring (LDS) antenna; and the LED lighting device further includes a reflecting shade mounted on the LED board.

12. The method for configuring the RF antenna according to claim 11, wherein:

the LED lighting device includes an LED board and at least one LED light source configured on the LED board;

the RF antenna has an annular shape with a central aperture to allow light beam emitted from the LED light source to pass through the central aperture without affecting the light-emitting path of the LED light source; and the heat sink includes a heat sink body, a plurality of heat sink fins longitudinally configured and distributed on an upper portion along an outer periphery of the heat sink body, and a cooling case housing the plurality of heat sink fins.

13. The method for configuring the RF antenna according to claim 12, further comprising fixing the LED board on a top surface of the heat sink body;

configuring the RF antenna in a socket on an outer periphery of the LED board; and configuring an upper portion of the cooling case higher than a top surface of each of the plurality of heat sink fins and the RF antenna.

14. The method for configuring the RF antenna according to claim 11, wherein:

the RF antenna is a flexible printed circuit board (FPC) antenna or a laser direct structuring (LDS) antenna;

the LED lighting device further includes a reflecting shade mounted on the LED board; and the heat sink includes a heat sink body, a plurality of heat sink fins longitudinally configured and distributed on an upper portion along an outer periphery of the heat sink body, and a cooling case housing the plurality of heat sink fins.

15. The method for configuring the RF antenna according to claim 14, further comprising:

mounting the RF antenna on the reflecting shade;

fixing the LED board on a top surface of the heat sink body;

configuring upper portions of both the plurality of heat sink fins and the cooling case higher than the LED board to form a cavity over the LED board; and configuring the reflecting shade in the cavity.

* * * * *